United States Patent [19]

Collier

[11] 4,049,586

[45] Sept. 20, 1977

[54] BUILDER SYSTEM AND DETERGENT PRODUCT

[75] Inventor: Everett J. Collier, Cincinnati, Ohio

[73] Assignee: The Procter & Gamble Company, Cincinnati, Ohio

[21] Appl. No.: 509,865

[22] Filed: Sept. 27, 1974

[51] Int. Cl.[2] ..... C11D 3/065

[52] U.S. Cl. ..... 252/532; 252/120; 252/135; 252/140; 252/145; 252/165; 252/527; 252/539; 252/551; 252/DIG. 11

[58] Field of Search ..... 252/532, 539, 140, 536, 252/165, 527, 145, 135, 551, DIG. 11, 120

[56] References Cited

U.S. PATENT DOCUMENTS 3,843,563 10/1974 Davies et al. ..... 252/527 X

FOREIGN PATENT DOCUMENTS 2,321,001 11/1973 Germany

*Primary Examiner*—Mayer Weinblatt

*Attorney, Agent, or Firm*—Robert B. Aylor; Thomas H. O'Flaherty; Richard C. Witte

[57] ABSTRACT

A builder system is provided for detergent compositions which comprises a precipitating builder, a crystallization seed, and a sequestering builder. The builder system may be formulated with a detergent and other components or may be used separately as an additive product.

12 Claims, No Drawings

BUILDER SYSTEM AND DETERGENT PRODUCT

BACKGROUND OF THE INVENTION

1. Field of the Invention

This invention relates to a builder system for use in detergent products.

2. Description of the Prior Art Practices

Detergent manufacturers have long recognized the need to control water hardness to ensure adequate cleaning by detergents. Even those detergent products which are not particularly hardness sensitive require some detergent builder to prevent the precipitation onto fabrics of water hardness ions particularly at the sites of body soil stains.

The detergency builders employed in the past have been of two main types; namely, sequestering builders and precipitating builders. Sequestering builders are true chelating agents which complex water hardness ions, mainly calcium and magnesium, to lessen the ability of such ions to interfere with the detergency process. Examples of commonly used sequestering builders are the water-soluble salts of pyrophosphates, tripolyphosphates, and nitrilotriacetates. Granular detergent products sold today in the United States contain up to about 50% by weight of the aforementioned phosphate salts. The use of water-soluble phosphate salts as detergency builders has been under criticism because phosphates are believed to accelerate eutrophication or aging of natural water bodies. Unfortunately, most other sequestering builders are unable to control hardness as effectively as the water-soluble salts of pyrophosphate and tripolyphosphate in amounts which are feasible for use in a detergent composition.

Alternatively, some detergent manufacturers have turned to the use of precipitating builders such as the water-soluble salts of carbonates and silicates to achieve water hardness control. It is noted at this point that while the water-soluble salts of carbonates and silicates are classed as precipitating builders, these materials may also associate with the water-hardness ions in a wash solution.

The presence of soluble carbonates or soluble pyrophosphates alone as builders results in the deposition of the respective insoluble calcium salts of both upon the washed fabrics.

It has been previously suggested in British Patent No. 607,274 (Madsen), Canadian Patent No. 511,607 (Cocks et. al.), and Belgian Patent No. 798,856 (Jacobson et. al.) herein incorporated by reference that the rate of depletion of hardness ions from a wash solution may be increased by the use of crystallization seeds in conjunction with the precipitating builder. The crystallization seeds function as growth sites for the hardness ions and the anion of the precipitating builder. Calcium carbonate crystallization seeds are most desirable in that they are inexpensive and relatively easy to process as well as being an excellent growth site for calcium salts, particularly those having a carbonate anion. The deficiency in using calcium carbonate crystallization seeds in combination with water-soluble salts of carbonates, bicarbonates, and sesquicarbonates is that although the system is very efficient in rapidly reducing the level of soluble calcium, the remainder of the hardness ions present, particularly magnesium, is too soluble to permit precipitation with the aforementioned water-soluble salts. The term "soluble calcium" which is used interchangably with free calcium ions includes free divalent calcium ions as well as ion pairs such as mono-molecular calcium carbonate which is in rapid equilibrium with the calcium ions.

In an article, *Effect of Impurities on Precipitation of Calcium,* by Schonfeld, in the *Journal of the American Water Works Association,* June 1964, pp. 767–773, it is stated that as little as from 1.5 to 3.0 ppm of builders such as hexametaphosphate, pyrophosphate, and orthophosphate anions will effectively negate the ability of as much as 5,000 ppm of a precipitating builder such as sodium carbonate to rapidly remove soluble calcium from solution. It is also known that slightly higher concentrations of materials such as soluble ethylene diamine tetracetates, ammonium oxylate, sodium tripolyphosphate, and other sequestering builders will also have a substantial effect on the ability of a precipitating builder such as sodium carbonate to depletefree calcium from a wash solution.

It is further known that minute amounts of materials such as the water-soluble salts of pyrophosphates, tripolyphosphates, nitrilotriacetates, and other sequestering builders will upon intimate contact with calcium carbonate crystallization seeds render the seeds ineffective in accelerating the rateof calcium depletion. Stated otherwise, sequestering builders poison the crystallizaton seeds to such an extent that the precipitating builder effectively functions alone. The amount of sequestering builder or similar material which renders the calcium carbonate crystallization seed ineffective will vary with the type of material, i.e., sequestering builder employed. It is generally sufficient to say that when a sequestering builder is in intimate slurry contact with the calcium carbonate crystallization seed that as little as 1.5 ppm of the sequestering builder is sufficient to poison the crystallization seed rendering it ineffective. For instance, 1.5 ppm of sodium pyrophosphate in an aqueous slurry is sufficient to adsorb over the entire surface area of a 0.25 micron calcium carbonate crystallization seed which is present at 60 ppm. Since the crystallization seed level above corresponds to 5% by weight in a typical detergent product when used at suggested levels, it would appear necessary to reduce the level of the phosphate to the point at which it would be ineffective as a builder in a detergent product.

It has been discovered that it is possible to formulate a detergent builder system or complete detergent product utilizing a crystallization seed, a precipitating builder, namely a water-soluble salt of carbonates, bicarbonates, or sesquicarbonates and a sequestering builder. Contrary to what one would expect from the prior art, it has been found that substantial amounts of sequestering builders, for example, the water-soluble salts of pyrophosphates, tripolyphosphates, and nitrilotriacetates may be present in a wash solution at the same time as the calcium carbonate crystallization seed and the aforementioned precipitating builders salts without substantially interfering with the removal of soluble calcium ions by precipitation. While some effect on the precipitation of soluble calcium will occur from the use of sequestering builders contemporaneously with the crystallization seed and precipitating builder, it is much less than one would predict upon comparing the individual effect of the sequestering builders upon systems containing the precipitating builder salts alone or upon the effect of sequestering builders on the growth of crystallization seeds such as is observed in the processes for the manufacture of commercial calcium carbonate.

It has been surprisingly discovered that the benefits of the present invention in attaining calcium and magnesium ion control in the wash solution allows form satisfactory detergency results in low or no phosphate detergent compositions.

Another advantage of the present invention in its low phosphate aspect compared to non-phosphate detergent products is that the former gives granules which are more resistant to humidity-caking.

The benefits of the present invention in its non-phosphate aspect allow the use of expensive sequestering builders at amounts much lower than would otherwise be required to achieve water hardness control. In the case of non-phosphate compositions of the present invention, it is also possible to use sequestering builders which are economically attractive but which lack the water hardness sequestration ability of the water-soluble pyrophosphates and tripolyphosphates. It has also been observed that when the builder system of the present invention contains soluble pyrophosphate that calcium pyrophosphate precipitation which normally occurs on fabrics is greatly diminished. Pyrophosphate may be present as a builder or from reversion of higher polyphosphate species.

Throughout the specification and claims, percentages and ratios given are by weight unless otherwise indicated, and temperatures are in Fahrenheit degrees.

SUMMARY OF THE INVENTION

The invention as a detergent additive therefore comprises:

a. from about 1% to about 90% by weight of submicron calcium carbonate particles;
b. from about 0.5% to about 80% by weight of a builder selected from the group consisting of the alkali metal carbonates, bicarbonates, and sesquicarbonates and mixtures thereof; and,
c. from about 5% to about 70% by weight of a sequestering builder component and mixtures thereof.

The second aspect of this invention is a particulate detergent product comprising:

a. from about 0.5% to about 50% by weight of submicron calcium carbonate particles;
b. from about 5% to about 70% by weight of a builder selected from the group consisting of the alkali metal carbonates, bicarbonates, and sesquicarbonates and mixtures thereof;
c. from about 5% to about 70% by weight of a sequestering builder component and mixtures thereof; and,
d. from about 5% to about 40% by weight of a water-soluble detergent selected from the group consisting of anionic, nonionic, zwitterionic, and ampholytic detergents and mixtures thereof.

DETAILED DESCRIPTION OF THE INVENTION

The precipitating builders to be used with the calcium carbonate crystallization seed are the alkali metal salts of carbonates, bicarbonates, and sesquicarbonates. The preferred water-soluble precipitating builder salt for use in the present invention is sodium carbonate. In an additive-type product the amount of the water-soluble precipitating builder salt is from about 0.5% by weight to about 80% by weight, preferably from about 10% by weight to about 60% by weight, and most preferably from about 25% by weight to about 50% by weight. An additive-type product is intended for use to presoften water or as a supplement to commercial detergent products. In a complete detergent product the amount of water-soluble precipitating builder salt is from about 5% to about 70%, preferably from about 20% to about 55%, and most preferably from about 25% to about 40% by weight.

The calcium carbonate employed in this invention may be of the calcite, aragonite, or vatarite crystal structure, most preferably calcite. The amount of calcium carbonate crystallization seed present is dependent upon a variety of factors, for example, the mean particle diameter of the crystals, the nominal surface area, the degree of agglomeration of the crystals, the temperature of the wash water, and the particular choice and amount of the precipitating builder to be used with the crystallization seed. As the crystallization seed functions by providing growth sites for the soluble calcium ions to precipitate upon, the nature of the crystal surface of the seed is most important. The nominal surface area of the crystallization seed is a physical measurement of the total surface area. The effective surface area of a crystallization seed is directly proportional to the amount of soluble calcium which is depleted in a given time from a wash solution by a given weight of calcium carbonate crystallization seeds when used in combination with a precipitating builder of the present invention. Crystallization seeds which have been poisoned, for example, by sodium tripolyphosphate will have the same nominal surface area as unpoisoned crystallization seeds but will have an effective surface area near zero. Calcium carbonate crystallization seeds are present in the additive product at from about 1% to about 90% by weight, preferably from about 5% to about 70%, and most preferably from about 10% to about 40%. In a detergent product the calcium carbonate crystallization seeds are present at from about 0.5% to about 50% by weight, preferably from about 1% to about 25%, and most preferably from about 3% to about 20% by weight.

The most meaningful measure of the effective surface area is the mean particle diameter of the crystallization seeds, as the mean diameter for any given crystal form dictates the surface area and the number of crystallization seeds per unit mass. The surface area per unit mass is inversely proportional to the mean particle diameter; thus, the smaller mean particle diameters provide higher effective surface area crystallization seeds. The mean particle diameter of the crystallization seeds in the present invention is less than 1 micron, preferably from about 0.01 to about 0.5 micron, more preferably from about 0.01 to about 0.25 micron, and most preferably from about 0.01 to about 0.10 of a micron. One such method of preparing calcium carbonate particles of extremely small mean particle diameter and high nominal surface area is found in U.S. Pat. No. 2,981,596 entitled "Preparation of Alkine Earth Carbonates", issued to Raymond R. McClure, patented Apr. 25, 1961, herein incorporated by reference. Further data on statistical measurements of the calcium carbonate crystallization seed particles which may be usedin the present invention is disclosed in the concurrently filed U.S. application Ser. No. 509,863, entitled "Process for the Preparation of Spray-Dried Calcium Carbonate Containing Granules," to Cherney and also in U.S. application Ser. No. 509,864, entitled "Calcium Carbonate Containing Granule," to Cherney.

Calcium carbonate seeds which are suitable for use in the present invention are available under the trade names Purecal O, Purecal T, and Purecal U of the Wyandotte Chemical Company. The calcium carbonate is preferably admixed dry into the detergent or additive product but may be combined into a granule contained components which do not poison the crystallization seeds.

The additive product or the detergent composition of the present invention has a weight ratio of the water-soluble precipitating builder to the calcium carbonate crystallization seed of from about 80:1 to about 1:2, preferably from about 40:1 to about 1:1, and most preferably from about 20:1 to about 2:1.

The sequestering builder of the present invention is present in the additive product at from about 5% to about 70%, preferably from about 10% to about 60%, and most preferably from about 15% to about 50% by weight. The detergent product of the present invention has the sequestering builder present at from about 5% to about 70%, preferably from about 10% to about 60%, and most preferably from about 15% to about 50% by weight. In either the additive product or the detergent composition a large proportion of the soluble calcium is removed from the wash solution by precipitating builder-crystallization seed system leaving the sequestering builder to control the residual free calcium ions and the magnesium ions present. Thus, once a particular crystallization seed is chosen and the level of the water-soluble precipitating builder is fixed in a given composition, the amount of the sequestering builder required to deplete the remaining hardness may be calculated.

The sequestering builders of the present invention are, for example, water-soluble salts of phosphates, pyrophosphates, polyphosphates, phosphonates, polyhydroxysulfonates, polyacetates, carboxylates, polycarboxylates, and succinates. Specific examples of inorganic phosphate builders include sodium and potassium tripolyphosphates, pyrophosphates, phosphates, and hexametaphosphates. The polyphosphonates specifically include, for example the sodium and potassium salts of ethylene diphosphonic acid, the sodium and potassium salts of ethane 1-hydroxy-1,1-diphosphonic acid and the sodium and potassium salts of ethane-1,1,2-triphosphonic acid. Examples of these and other phosphorous builder compounds are disclosed in U.S. Pat. Nos. 3,159,581; 3,213,030; 3,422,021; 3,422,137; 3,400,176; and 3,400,148, incorporated herein by reference.

Water-soluble, organic sequestering builders are also useful herein. For example, the alkali metal, ammonium and substituted ammonium polyacetates, carboxylates, polycarboxylates, and polyhydroxysulfonates are useful sequestering builders in the present compositions. Specific examples of the polyacetate and polycarboxylate builder salts include sodium potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Highly preferred non-phosphorus sequestering builder materials herein include sodium citrate, sodium oxydisuccinate, sodium mellitate, sodium nitrilotriacetate, and sodium ethylene diamine tetraacetate and mixtures thereof.

Other highly preferred sequestering builers herein are the polycarboxylate builders set forth in U.S. Pat. No. 3,308,067, Diehl, incorporated herein by reference. Examples of such materials include the water-soluble salts of the homo- and co-polymers of aliphatic carboxylic acids such as maleic acid, itaconic acid, mesaconic acid, fumaric acid, aconitic acid, citraconic acid, methylenemalonic acid, 1,1,2,2-ethane tetracarboxylic acid, dihydroxy tartaric acid, and keto-malonic acid.

Additional preferred sequestering builders herein include the water-soluble salts, especially the sodium and potassium salts of carboxymethyloxymalonate, carboxymethyloxysuccinate, cis-cyclohexanehexacarboxylate, cis-cyclopentanetetracarboxylate, and phloroglucinol trisulfonate.

Most preferably, the sequestering builder of the present invention is a water-soluble salt, particularly the sodium and potassium salts of tripolyphosphates, pyrophosphates, and nitrilotriacetates.

When prepared as a detergent composition, the present invention may include all manner of anionic, nonionic, ampholytic, and zwitterionic detergents or mixtures thereof. The level of the detergent component in the product is from about 5% to about 40%, preferably from about 10% to about 30%, and most preferably from about 12% to about 25% by weight.

Detergent Component

Preferably the detergent component of the instant invention is a water-soluble salt of: an ethoxylated sulfated alcohol with an average degree of ethoxylation of about 1 to 4 and an alkyl chain length of about 14 to 16; tallow triethoxy sulfate; tallow alchol sulfates; an alkyl benzene sulfonate with an average alkyl chain length between 11 and 12, preferably 11.2 carbon atoms; an $\alpha$-sulfocarboxylic acid or ester thereof wherein the acid radical contains 8 to 20 carbons and the alcohol radical contains 1 to 15 carbon atoms; a $C_8$–$C_{24}$ paraffin sulfonate; a $C_{10}$–$C_{24}$ $\alpha$-olefin sulfonate or mixtures thereof; or other anionic sulfur-containing detergent. Such preferred detergents are discussed below.

An especially preferred alkyl ether sulfate detergent component of the instant compositions is a mixture of alkyl ether sulfates, said mixture having an average (arithmetic mean) carbon chain length within the range of from about 12 to 16 carbon atoms, preferably from about 14 to 15 carbon atoms, and an average (arithmetic mean) degree of ethoxylation of from about 1 to 4 moles of ethylene oxide, preferably from about 2 to 3 moles of ethylene oxide. Specifically, such preferred mixtures comprise from about 0 to 20% by weight of mixture of $C_{12-13}$ compounds, from about 60% to 100% by weight of mixture of $C_{14-15-16}$ compounds and from about 0 to 20% by weight of mixture of $C_{17-18-19}$ compounds. Further, such preferred alkyl ether sulfate mixtures comprise from about 3% to 30% by weight of mixture of compounds having a degree of ethoxylation of 0, from about 45% to 90% by weight of mixture of compounds having a degree of ethyoxylation from 1 to 4, from about 10% to 25% by weight of mixture of compounds having a degree of ethoxylation from 5 to 8 and from about 0.1% to 15% by weight of mixture of compounds having a degree of ethoxylation greater than 8. The sulfated condensation products of tallow ($C_{10}$–$C_{20}$) alcohol with from 1 to 30, preferably 1 to 10, and most preferably 1 to 4 moles of ethylene oxide may be used in place of or mixed with the preferred alkyl ether sulfates discussed above.

Another class of detergents includes water-soluble salts, particularly the alkali metal, ammonium and alkylolammonium salts of organic sulfuric reaction products having in their molecular structure an alkyl group containing from about 8 to about 22 carbon atoms and a sulfuric acid ester group. Examples of this group of synthetic detergents which form a part of the detergent compositions of the present invention are the sodium and potassium alkyl sulfates, especially those obtained by sulfating the higher alcohols ($C_8$–$C_{18}$ carbon atoms) produced by reducing the glycerides of tallow or coconut oil.

Preferred water-soluble organic detergent compounds herein include linear alkyl benzene sulfonates containing from about 9 to 15 carbon atoms in the alkyl group. Examples of the above are sodium and potassium alkyl benzene sulfonates in which the alkyl group contains from about 11 to about 13 carbon atoms, in straight chain or branched chain configuration, e.g. those of the type described in U.S. Pat. Nos. 2,220,099 and 2,477,383. Especially valuable are straight chain alkyl benzene sulfonates in which the average of the alkyl groups is about 11.2 carbon atoms, abbreviated as $C_{11.2}$LAS.

Another useful detergent compound herein includes the water-soluble salts of esters of α-sulfonated fatty acids containing from about 6 to 20 carbon atoms in the fatty acid group and from about 1 to 10 carbon atoms in the alcohol radical.

Preferred "olefin sulfonate" detergent mixtures utilizable herein comprise olefin sulfonates containing from about 10 to about 24 carbon atoms. Such materials can be produced by sulfonation of α-olefins by means of uncomplexed sulfur trioxide followed by neutralization under conditions such that any sultones present are hydrolyzed to the corresponding hydroxy-alkane sulfonates. The α-olefin starting materials preferably have from 14 to 16 carbon atoms. Said preferred α-olefin sulfonates are described in U.S. Pat. No. 3,332,880, incorporated herein by reference.

The paraffin sulfonates embraced in the present invention are essentially linear and contain from 8 to 24 carbon atoms, preferably 12 to 20 and more preferably 14 to 18 carbon atoms in the alkyl radical.

Other anionic detergent compounds herein include the sodium alkyl glyceryl ether sulfates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Water-soluble salts of the higher fatty acids, i.e. "soaps," are useful as the detergent component of the composition herein. This class of detergents includes ordinary alkali metal soaps such as the sodium, potassium, ammonium and alkylolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Water-soluble nonionic synthetic detergents are also useful as the detergent component of the instant composition. Such nonionic detergent materials can be broadly defined as compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

For example, a well-known class of nonionic synthetic detergents is made available on the market under the trade name "Pluronic" sold by Wyandotte Chemicals. These compounds are formed by condensing ethylene oxide with a hydrophobic base formed by the condensation of propylene oxide with propylene glycol. Other suitable nonionic synthetic detergents include the polyethylene oxide condensates of alkyl phenols, e.g. the condensation products of alkyl phenols having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkyl phenol.

The water-soluble condensation products of aliphatic alcohols having from 8 to 22 carbon atoms, in either straight chain or branched configuration, with ethylene oxide, e.g. a coconut alcohol-ethylene oxide condensate having from 5 to 30 moles of ethylene oxide per mole of coconut alcohol, the coconut alcohol fraction having from 10 to 14 carbon atoms, are also useful nonionic detergents herein.

Semi-polar nonionic detergents include water-soluble amine oxides containing one alkyl moiety of from about 10 to 28 carbon atoms and 2 moieties selected from the group consisting of alkyl groups and hydroxyalkyl groups containing from 1 to about 3 carbon atoms; water-soluble phosphine oxide detergents containing one alkyl moiety of about 10 to 28 carbon atoms and 2 moieties selected from the group consisting of alkyl groups and hydroxyalkyl groups containing from about 1 to 3 carbon atoms; and water-soluble sulfoxide detergents containing one alkyl moiety of from about 10 to 28 carbon atoms and a moiety selected from the group consisting of alkyl and hydroxyalkyl moieties of from 1 to 3 carbon atoms.

Ampholytic detergents include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic detergents include derivatives of aliphatic quaternary ammonium, phosphonium and sulfonium compounds in which the aliphatic moieties can be straight chain or branched, and wherein one of the aliphatic substituents contains from about 8 to 18 carbon atoms and one contains an anionic water-solubilizing group.

Other useful detergents include water-soluble salts of 2-acyloxy-alkane-1-sulfonic acids containing from about 2 to 9 carbon atoms in the acyl group and from about 9 to about 23 carbon atoms in the alkane moiety; α-alkyloxy alkane sulfonates containing from about 1 to 3 carbon atoms in the alkyl group and from about 8 to 20 carbon atoms in the alkane moiety; alkyl dimethyl amine oxides wherein the alkyl group contains from about 11 to 16 carbon atoms; alkyldimethyl-ammonio-propane-sulfonates and alkyl-dimethyl-ammonio-hydroxy-propane-sulfonates wherein the alkyl group in both types contains from about 14 to 18 carbon atoms; soaps as hereinabove defined; the condensation product of tallow fatty alcohol with about 11 moles of ethylene oxide; the condensation product of a $C_{13}$ (avg.) secondary alcohol with 9 moles of ethylene oxide; and alkyl glyceral ether sulfates with from 10 to 18 carbon atoms in the alkyl radical.

A typical listing of the classes and species of detergent compounds useful herein appear in U.S. Pat. No. 3,664,961, incorporated herein by reference. The following list of detergent compounds which can be used in the instant compositions is representative of such materials, but is not intended to be limiting.

It is to be recognized that any of the foregoing detergents can be used separately herein or as mixtures.

Further useful detergents are ethoxylated zwitterionic compounds described in U.S. patent application Ser. No. 493,953, entitled DETERGENT COMPOSITION HAVING ENHANCED PARTICULATE SOIL REMOVAL PERFORMANCE, to Laughlin and Heuring, filed Aug. 1, 1974, herein incorporated by reference, specifically including the cosurfactant disclosure in the Laughlin and Heuring Application.

It is advantageous to incorporate into a single granule both the sequestering builder and the detergent as well as other detergent components to facilitate processing and to avoid interference with the crystallization seed by the detergent as described in Belgian Patent No. 798,856. Thus, the detergent component may be within the granule containing the sequestering builder or may form a separate granule.

The water-soluble precipitating builder of the present invention is present in either the detergent product or the additive product, preferably as a powder or as a granule; and some or all of the precipitating builder may be prepared by crutching a mixture of the water-soluble precipitating builder and the sequestering builder, and then forming a granule containing both builders.

It is preferred that the granules to be present in the product be spray-dried by the method described in U.S. Pat. No. 3,629,951 entitled MULTILEVEL SPRAY-DRYING METHOD to Robert P. Davis et al, issued Dec. 28, 1971. Other methods of preparing the sequestering builder granule and/or the detergent include the techniques of agglomeration or drum drying of the former being described, for example, in U.S. Pat. No. 3,597,361 entitled METHOD OF PREPARING AGGLOMERATED DETERGENT COMPOSITION to Sumner, issued Aug. 3, 1971.

Water-soluble silicates having a $M_2O:SiO_2$ weight ratio of from 1:1 to 1:3.2 are desirable for forming crisp granules and protecting washing machine surfaces. M is preferably sodium or potassium. As silicates have a tendency to adsorb onto calcium carbonate crystals, the incorporation of the silicate is preferably accomplished such that the crystallization seed is not in intimate contact with the silicate. Such silicates are present at from about 5% to about 40%, preferably from about 10% to about 30% in the detergent or additive products.

The additive product or the detergent composition of the present invention may contain all manner of other materials which are ordinarily present in detergent composition, provided that they do not interfere with the precipitating builder-crystallization seed system. Such additional detergent components include bleach, brighteners, dyes, soils suspending agents, and the like.

The intended level of usage of most detergent products generally varies from ½ a cup to 1½ cups with the washing machine capacity from 10 to 22 gallons. An additive product of the present invention is preferably added to the wash solution before the detergent product however simultaneous addition may be used. Washing temperatures may vary between about 70% and 120°F.

The relative effectiveness of the compositions of the present invention is determined by actual wash performance or by measuring the amount of water hardness control as is described in the copending applications of Cherney previously incorporated by reference. When testing of the actual cleaning ability is desired, soiled cloth swatches are washed with the product as described above and compared to standard test swatches by means of a Hunter whiteness meter. The product usage level in the examples is 0.12% by weight, unless otherwise indicated.

The following examples are illustrative of the invention:

EXAMPLE I

The following detergent additive product is prepared according to the present invention:

20% calcium carbonate in the form of calcite crystals having a mean particle diameter of about 0.25 micron 60% sodium carbonate present in a granular form 20% sodium tripolyphosphate.

The additive product is tested for the rate and amount of calcium and magnesium depletion by specific ion electrodes in a system containing mixed calcium and magnesium water hardness in a ratio of 2:1 respectively at 4, 7, and 12 grains of total water hardness.

The above example may be modified by including 10% sodium silicate in the place of 10% of the sodium carbonate with the silicate having a 1:2.4 ratio of $Na_2O:SiO_2$. The sequestering builder used above may be replaced by sodium pyrophosphate, the sodium salt of ethylene diamine trinitrilotetraacetic acid, or sodium nitrilotriacetate.

EXAMPLE II

The following detergent additive product is prepared according to the present invention:

90% calcium carbonate in the form of calcite crystals having a mean particle diameter of about 0.25 micron 5% sodium carbonate present in powdered form 5% sodium tripolyphosphate.

The additive product is tested for the rate and amount of calcium and magnesium depletion by specific ion electrodes in a system containing mmixed calcium and magnesium water hardness in a ratio of 2:1 respectively at 4, 7, and 12 grains of total water hardness.

The above example may be modifed by substituting sodium sesquicarbonate or sodium bicarbonate for the sodium carbonate. The sequestering builder used above may be replaced by sodium pyrophosphate, the sodium salt of ethylene diamine trinitrilotetraacetic acid, or sodium nitrilotriacetate.

EXAMPLE III

The following detergent additive product is prepared according to the present invention:

1% calcium carbonate in the form of calcite crystals having a mean particle diameter of about 0.25micron 80% sodium carbonate present in a granular form 19% sodium tripolyphosphate.

The additive product is tested for the rate and amount of calcium and magnesium depletion by specific ion electrodes in a system containing mixed calcium and magnesium water hardness in a ratio of 2:1 respectively at 4, 7, and 12 grains of total water hardness.

The above example may be modified by including 10% sodium silicate in the place of 10% of the sodium carbonate with the silicate having a 1:2.4 ratio of $Na_2O$:-$SiO_2$. The sequestering builder used above may be replaced by sodium pyrophosphate, the sodium salt of ethylene diamine trinitrilotetraacetic acid, or sodium nitrilotriacetate.

EXAMPLE IV

The following detergent additive product is prepared according to the present invention:

29.5% calcium carbonate in the form of calcite crystals having a mean particle diameter of about 0.95 micron 0.5% sodium carbonate present in a granular form 70% sodium tripolyphosphate.

The additive product is tested for the rate and amount of calcium and magnesium depletion by specific ion electrodes in a system containing mixed calcium and magnesium water hardness in a ratio of 2:1 respectively at 4, 7, and 12 grains of total water hardness in a 1:1 ratio with a detergent product containing 50% sodium carbonate.

The sequestering builder used above may be replaced by sodium pyrophosphate, the sodium salt of ethylene diamine trinitrilotetraacetic acid, or sodium nitrilotriacetate.

EXAMPLE V

The following detergent additive product is prepared according to the present invention:

35% calcium carbonate in the form of calcite crystals having a mean particle diameter of about 0.01 micron 35% sodium carbonate present in a granular form 30% sodium tripolyphosphate.

The additive product is tested for the rate and amount of calcium and magnesium depletion by specific ion electrodes in a system containing mixed calcium and magnesium water hardness in a ratio of 2:1 respectively at 4, 7, and 12 grains of total water hardness.

The above example may be modified by including 10% sodium silicate in the place of 10% of the sodium carbonate with the silicate having a 1:2.4 ratio of $Na_2O$:-$SiO_2$. The sequestering builder used above may be replaced by sodium pyrophosphate, the sodium salt of ethylene diamine trinitrilotetraacetic acid, or sodium nitrilotriacetate.

Examples I–V, prepared by the present invention, satisfactorily deplete calcium and magnesium water hardness; and when used with a detergent product, the combination cleans better than the detergent product alone.

EXAMPLE VI

The following detergent compositions (Table 1) are prepared and graded for performance in Hunter whiteness units (ΔH) by comparing clay soiled dacron swatches washed with the compositions to soiled unwashed dacron swatches. The product usage is at 0.12% by weight in 100° F water with 7 grains hardness (2:1 $Ca^{++}/Mg^{++}$). The amount of each component is given in parts with minors and inert excluded with 0.025 micron calcium carbonate particles being employed.

Table 1

| Sodium Pyrophospate | Sodium Carbonate | Calcium Carbonate | Sodium $C_{15}$ Triethoxy Sulfate | Tallow Alkyl Sulfate | $C_{12}$ LAS | Sodium Silicate $Na_2O:SiO_2$ 1:2.4 | Sodium Tripolyphosphate | Δ H |
|---|---|---|---|---|---|---|---|---|
| 25 | 15 | 15 | 15 | 2 | — | 15 | — | 36 |
| 25 | 20 | 10 | 15 | 2 | — | 15 | — | 37 |
| 25 | 25 | 5 | 15 | 2 | — | 15 | — | 37 |
| — | — | — | — | 9.2 | 7.6 | 5.9 | 49.4 | 37 |
| 25 | 25 | — | 15 | 2 | — | 15 | — | 34 |
| 25 | — | 25 | 15 | 2 | — | 15 | — | 33 |
| — | 25 | 22 | 15 | 2 | — | 15 | — | 14 |

Products containing crystallization seeds, pyrophosphate and sodium carbonate shows less fabric deposition than the products formulated without one or more of these components.

The compositions tested in Example VI show that products made by the present invention perform better in cleaning and hardness depletion than known compositions.

EXAMPLE VII

The following detergent composition is prepared:

10.5% calcium carbonate having a mean particle diameter of about 0.01 micron

70% sodium carbonate in a powdered or granular form

5% by weight $C_{12}$ LAS (linear alkyl benzene sulfonate having an alkyl radical averaging aproximately 12 carbon atoms).

14.5% sodium pyrophosphate wherein the pyrophosphate, and the detergent are spray dried.

EXAMPLE VIII

The following detergent composition is prepared:

0.5% calcium carbonate having a mean particle diameter of about 0.01 micron

5% sodium carbonate in a powdered or granular form 14.5% sodium silicate with a ratio of $Na_2O:SiO_2$ of 1:2.4

10% by weight $C_{12}$ LAS (linear alkylbenzene sulfonate having an alkyl radical averaging approximately 12 carbon atoms)

70% sodium pyrophosphate wherein the pyrophosphate, silicate, and the detergent are spray dried.

EXAMPLE IX

The following detergent composition is prepared:

10% calcium carbonate having a mean particle diameter of about 0.10 micron

40% sodium sesquicarbonate in a powdered or granular form

5% sodium silicate with a ratio of $Na_2O:SiO_2$ of 1:2.4

40% by weight middle-cut coconut hexaethoxylated alcohol

5% sodium pyrophosphate wherein the pyrophosphate, silicate, sodium carbonte, and the detergent are spray dried.

EXAMPLE X

The following detergent composition is prepared:

50% calcium carbonate having a mean particle diameter of about 0.95 micron

25% sodium carbonate in a powdered or granular form

5% sodium silicate with a ratio of $Na_2O:SiO_2$ of 1:2.4

10% by weight $C_{12}$ LAS (linear alkyl benzene sulfonate having an alkyl radical averaging approximately 12 carbon atoms)

10% sodium pyrophosphate.

The compositions of the present invention formulated in Examples VII–X perform satisfactorily in cleaning ability.

What is claimed is:

1. A particulate detergent product consisting essentially of:

a. from about 0.5% to about 50% by weight of dry admixed calcium carbonate particles having a mean diameter of from about 0.01 to about 0.50 micron;

b. from about 5% to about 70% by weight of a builder selected from the group consisting of the alkali metal carbonates, bicarbonates, and sesquicarbonates and mixtures thereof;

c. from about 5% to about 70% by weight of alkali metal pyrophosphate; and d. from about 5% to about 40% by weight of a water-soluble detergent selected from the group consisting of anionic, nonionic, zwitterionic, and ampholytic detergents and mixtures thereof.

2. The composition of claim 1 wherein the mean diameter of the submicron calcium carbonate particles if from about 0.01 to about 0.25 micron.

3. The composition of claim 2 wherein component (d) is selected from the group consisting of non-soap anionic and nonionic detergents.

4. The compositions of claim 3 wherein the weight ratio of component (b) to the calcium carbonate is from about 80:1 to about 1:2.

5. The composition of claim 4 wherein the mean diameter of the submicron carbonate particles is from about 0.01 to about 0.10 micron.

6. The composition of claim 5 wherein component (a) is present at from about 1% to about 25% and component (b) is present at from about 20% to about 55% by weight.

7. The composition of claim 6 wherein component (d) is selected from the group consisting of:

a. alkyl ether sulfates wherein the alkyl chain has from about 12 to 20 carbon atoms and the degree of ethoxylation is from 1 to 30;

b. alkali metal salts of an alkyl sulfate wherein the alkyl group has from 8 to 22 carbon atoms;

c. alkali metal salts of an alpha-olefin sulfonate wherein the alkyl group has from 10 to 24 carbon atoms;

d. alkali metal salts of an alkyl benzene sulfonate wherein the alkyl radical has from 9 to 15 carbon atoms;

e. mixtures of alpha-sulfo carboxylic acid esters wherein the acid radical has from 6 to 20 carbon atoms and the alcohol radical has from 1 to 10 carbon atoms; and f. ethoxylated alcohols wherein the alcohol radical has 8 to 22 carbon atoms condensed with from 5 to 30 moles of ethylene oxide;

and mixtures thereof.

8. The composition of claim 7 additionally comprising from about 5% to about 40% by weight sodium silicate having a $Na_2O:SiO_2$ ratio of from about 1:1 to about 1:3.2.

9. The composition of claim 8 wherein component (b) is sodium carbonate.

10. The composition of claim 9 wherein the weight ratio of the sodium carbonate to the calcium carbonate is from about 40:1 to 1:1.

11. The composition of claim 10 additionally comprising from about 10% to about 30% by weight sodium silicate having a $Na_2O:SiO_2$ ratio of from about 1:1 to about 1:3.2.

12. The composition consisting essentially of:

a. from about 0.5% to about 50% by weight of dry admixed calcium carbonate particles having a mean diameter of from about 0.01 to about 0.50 micron;

b. from about 5% to about 70% by weight of a builder selected from the group consisting of the alkali metal carbonates, bicarbonates, and sesquicarbonates and mixtures thereof;

c. from about 15% to about 50% by weight of alkali metal pyrophosphate; and d. from about 5% to about 40% by weight of a water-soluble detergent selected from the group consisting of anionic, nonionic, zwitterionic, and ampholytic detergents and mixtures thereof.

* * * * *